US009874213B2

(12) United States Patent
Yazykov

(10) Patent No.: US 9,874,213 B2
(45) Date of Patent: Jan. 23, 2018

(54) CENTRIFUGAL MULTIPLE-IMPELLER ELECTRIC PUMP

(71) Applicant: Andrey Yurievich Yazykov, Moscow (RU)

(72) Inventor: Andrey Yurievich Yazykov, Moscow (RU)

( * ) Notice: Subject to any disclaimer, the term of this patent is extended or adjusted under 35 U.S.C. 154(b) by 566 days.

(21) Appl. No.: 14/403,625

(22) PCT Filed: Jul. 19, 2013

(86) PCT No.: PCT/RU2013/000618
§ 371 (c)(1),
(2) Date: Nov. 25, 2014

(87) PCT Pub. No.: WO2013/180604
PCT Pub. Date: Dec. 5, 2013

(65) Prior Publication Data

US 2015/0192130 A1 Jul. 9, 2015

(30) Foreign Application Priority Data

May 25, 2012 (RU) ..... 2012121589

(51) Int. Cl.
*F04D 13/08* (2006.01)
*F04D 1/06* (2006.01)
(Continued)

(52) U.S. Cl.
CPC ..... *F04D 13/08* (2013.01); *F04D 1/06* (2013.01); *F04D 13/0693* (2013.01); *F04D 13/10* (2013.01)

(58) Field of Classification Search
CPC ..... F04D 13/08; F04D 1/06; F04D 13/0693; F04D 13/10; F04D 1/063
(Continued)

(56) References Cited

U.S. PATENT DOCUMENTS 4,964,788 A * 10/1990 Itameri-Kinter ..... H01R 13/74 174/152 GM
5,166,565 A * 11/1992 Katsuzawa ..... F16C 25/08 310/90
(Continued)

FOREIGN PATENT DOCUMENTS

RU 2198321 C1 2/2003
RU 2208708 C2 7/2003
(Continued)

OTHER PUBLICATIONS

English Translation of RU 77652 U1 obtained May 16, 2017.*

*Primary Examiner* — Devon Kramer
*Assistant Examiner* — Connor Tremarche
(74) *Attorney, Agent, or Firm* — Nadya Reingand; Yan Hankin

(57) ABSTRACT

A centrifugal multistage pump "VODOMET-WATER CANNON" contains electric motor, condensing case and pump stages, installed on the pump cases. The pump stages are located inside the case and are centered by the covers and, and also by the support. The bearing end shield of the electric motor is sealed with the elastic diaphragm. The condensing case is a leakproof cavity where the condenser and the cable connectors, of the electric motor are placed. The thermoswitch is located in the condensing box on the heat contactor. The pump stages include guide wheels and antifrictional washers. The washers interact with the axial supports—ceramic inlays that are inserted into the guide wheels. The inlays rest on the end clamps on the butt ends of the guide wheels. The guide wheels are sealed with radial inlays and together with pump stages create a hermetic tank.

8 Claims, 4 Drawing Sheets

Figure 1:
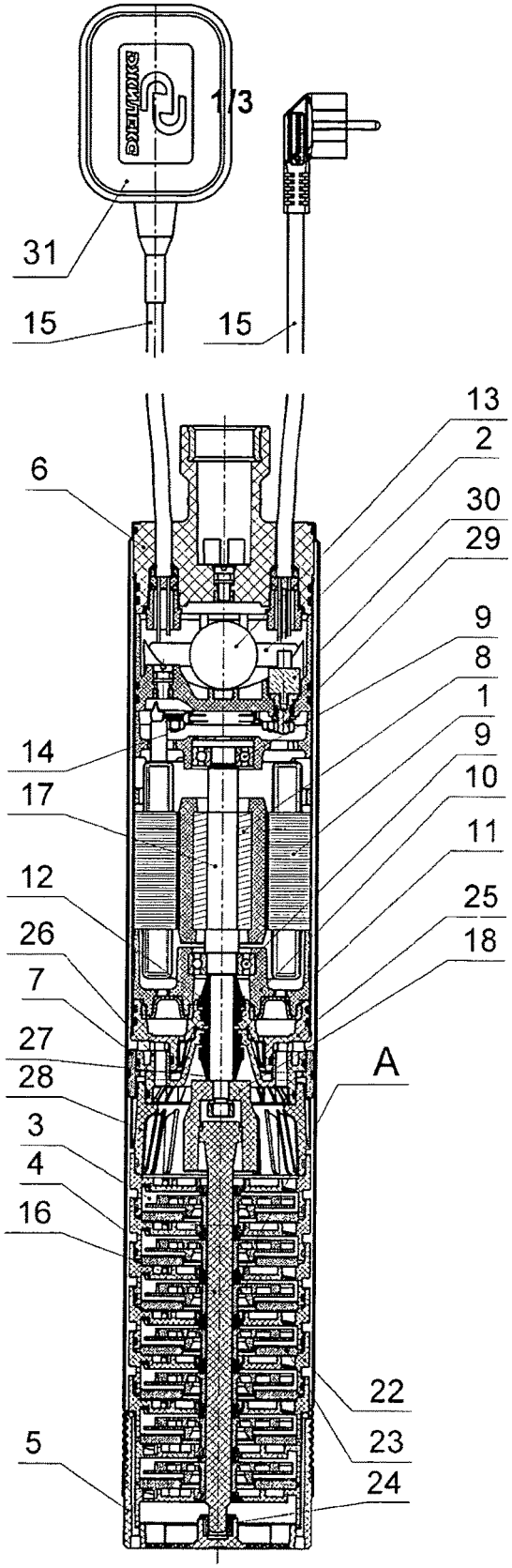

(51) Int. Cl.
*F04D 13/10* (2006.01)
*F04D 13/06* (2006.01)

(58) Field of Classification Search
USPC ..... 417/423.3
See application file for complete search history.

(56) References Cited

U.S. PATENT DOCUMENTS 5,290,047 A * 3/1994 Duffee ..... F16C 33/80
277/419
2011/0200469 A1* 8/2011 Kawabata ..... F04D 13/0606
417/423.3

FOREIGN PATENT DOCUMENTS

RU 2234620 C1 8/2004
RU 77652 U1 * 10/2008

* cited by examiner

CENTRIFUGAL MULTIPLE-IMPELLER ELECTRIC PUMP

The current application claims priority to PCT application No. PCT/RU2013/000618 filed on Jul. 19, 2013, which claims priority to Russian application No. RU 2012121589 filed on May 25, 2012.

FIELD OF THE INVENTION

This invention refers to hydraulic machinery construction field and particularly to centrifugal multiple impeller electric pumps which can be used either as main line pumps or as immersible pumps. Main line version of Vodomet pump is utilized for increasing pressure in a water supply line. Immersible version of Vodomet pump is utilized for pumping water from wells, reservoirs and surface water bodies in systems of domestic water supply and garden watering.

PRIOR ART

Immersible centrifugal electric pumps are well known in the art comprising a body with a cover plate made as a casing with axial intake and outlet pipes, a pump comprising multiple impellers and a shaft, and an electric motor including a rotor secured on a hollow shaft, a stator secured in the inner surface of the casing, end shields, where a hollow shaft is mounted in bearings located in counter bores; the shaft providing passage for pumped media and having an open end on one side and radial bores on another side, end shields being fitted with seals, and electric cable with sealed intake comprising a sealing bushing. Electric motor has a distance sleeve installed between the stator and the bearing end located on the pump impellers side, and circular section elastic rings. Bearing flat ends are pressed against the distance sleeve and the casing with a bolt and a nut, the bolt being installed in the hollow shaft and the nut having a possibility to press against the flat end of a bearing. Bearings are installed within the hollow shaft with a possibility of axial movement until pressed against stopper. End shield counter bores' sides facing stator have ledges limiting bearing movements, and an elastic ring is installed between the bearing and an end shield counter bore ledge. The cover has a threaded bore and outer cone-shaped surface and is secured in the casing with a circular section elastic ring (RU 2198321).

Immersible centrifugal electric pumps are well known in the art containing impellers with guides, the guides being fitted with main axial supports made of wear proof material, covers and impellers, each impeller having its own additional axial support being also a seal dividing suction and discharge cavities, and made as a protrusion on impeller flat end supported by cover plate surface; out-of-round section shaft with clearance fitted impeller shaft crown, its mounting bore corresponding to out-of-round section of the shaft, and spacing washers made of anti-friction material, impeller crown protruding over the flat end of the latter on the input side, spacer washers installed on the shaft with a possibility of axial movement at both sides of impeller crown, each washer having a hole corresponding to out-of-round section of the shaft and thickness less than the axial clearance formed by flat end of the crown and flat end of the main support, a guidance rig is installed before the first impeller, with main axial support flat end facing the impeller forming an axial clearance with a spacer washer, this clearance being less than additional axial support protrusion (RU 2234620).

Centrifugal electric well pumps are well known in the art containing a cylindrical case with annular intake and cylindrical intake filter, a cover with an intake pipe, impellers and a shaft, and an electric motor including a rotor, a stator, a sleeve-shaped body with sealed end shields and a shaft installed in end shield counter bores, and sealed cable input via bushing installed in an end shield, end shields being pressed against electric motor sleeve with a bolt and a nut, the nut representing a threaded axial bore in the shaft, and the bolt having a possibility to press against the flat end of a bearing, bearings on the shaft and in end shield counter bores are installed suitable for axial movement until pressed against stopper, with end shield counter bores' sides facing stator having ledges intended to limit bearing movements, and an elastic ring installed between the bearing and an end shield counter bore ledge; besides, a groove is made in the periphery of an end shield, and annular intake of the pump is formed by intake apertures and end bridges, the latter being curved into said groove and contacting its flat end made as a conical surface, its top facing pump axis; the pump case is connected with the cover through threaded connection, with the cover installed in contact with the flat end of the last impeller, and the filter is installed inside the case and is pressed against flat ends of the end shield and the first impeller, supporting pump impellers; to seal electric cable input, a ledged opening is made in an end shield, and a cone-shaped opening is made in carrier bushing, with an elastic ring installed in the ledged opening, pressed between the surfaces of carrier bushing cone-shaped opening, ledged opening in the end shield and electric cable (RU 2208708).

Shortcomings of pumps known in the art are complicated design and insufficient service life and operation reliability due to increased inner leakages and loads on pump case and separating membrane caused by pressure developed by the impellers and delivered by the pump.

Centrifugal electric multiple-impeller pumps are known in the art containing installed in their cases an electric motor and impellers comprising guidance rigs including wear proof axial supports, impeller covers and impellers, each impeller having a seal separating suction and discharge cavities, and made as a protrusion on impeller flat end supported by sealing element secured on cover plate surface; out-of-round section shaft where impeller crowns are installed with clearance fits permitting axial movement, spacing washers made of anti-friction material interacting with axial bearing, and a cable, with electric pump fitted with common casing having a front and rear cover plates, in-built capacitor box comprising a capacitor and terminals connecting cable with electric motor windings, and pump section shaft support made as an anti-friction bushing secured in the front cover plate, the electric motor being located on the impeller output side, its body installed in a case forming an annular channel and an intermediate support, front end shield of the electric motor is sealed with an elastic membrane, and sealing element secured on the cover plate is made as a thin-walled annular insert. In immersible version of the pump intake of the pump (on suction side) is made in the form of gauze suction apertures in the front cover plate, while in main line pump version pump intake is made in the form of a union in the front cover plate (RU 77652, prototype).

Shortcomings of pumps known in the art are complicated design and insufficient service life and operation reliability due to increased inner leakages and loads on pump body and separating membrane caused by pressure developed by the impellers and delivered by the pump.

From technical point of view, the task of the invention is creation of an effective centrifugal multiple impeller electric pump and widening the range of centrifugal multiple impeller electric pumps.

SUMMARY OF THE INVENTIONS

Technical result providing the solution of this task is increasing pump service life and operation reliability by means of reducing inner leakages and ensuring less loads on pump body and separating membrane caused by pressure developed by the impellers, using better design of intermediate body, and positioning thermal switch outside of oil filled volume of the pump. Electric motor shaft bearing being molded simultaneously with end shield molding is also meant to increase pump service life and operation reliability.

The essence of the invention is in a centrifugal multiple impeller electric pump having a casing containing consecutively installed in its bodies and interconnected with shafts electric motor and impeller sections with impellers, electric motor being installed at the discharge side of impeller sections, and installed in the casing forming annular passage for pumped media, with electric motor having an intermediate support and a front end shield sealed with an elastic membrane, installed in electric motor shaft in succession in two seals are electric motor multiple diameter front cover plate and multiple diameter intermediate body made with channels connecting outer surface of the membrane with the suction side of the impellers, and with channels connecting annular passage of the casing with the discharge side of the impellers.

Preferably, electric motor front cover plate and intermediate body are installed in succession between electric motor end shield and coupling, electric motor front cover plate having through bores, being supported at one side by the membrane forming annular cavity, and being sealed from electric motor shaft, inner wall of the casing and intermediate body which is made as a bushing with cone shaped central ledge supporting against electric motor front cover plate and sealed from the shaft of the latter, and connected by a bridge with the cone-shaped central ledge of the peripheral end sleeve sealed from the intermediate support and pump impeller package support, and having axial and non crossing radial bores, axial bores being connected with annular passage of the casing and with impeller package discharge side, and radial bores being connected with suction side of the latter and with the annular cavity formed between end shield membrane and electric motor front cover plate.

Besides, pump impellers are fitted with guidance rigs and axial supports, each impeller having a seal separating suction and discharge cavities, and anti-friction washers interacting with axial supports, with out-of-round section impeller package shaft suitable for axial movement of impeller installed on it, and electric motor shaft bearing being cast in the end shield when the latter is cast.

Impeller seals are made as thin-walled inserts, electric pump is fitted with an in-built capacitor box comprising a thermal switch, capacitor and terminals connecting cable with electric motor windings, axial supports of impellers are made of wear proof material, casing is made with front and rear cover plates, and anti-friction bushing is installed in the front cover plate, electric motor is fitted with a union installed in the rear cover plate, electric motor has square-cage rotor and oil-filled case.

SHORT DESCRIPTION OF DRAWINGS

Figure 2:
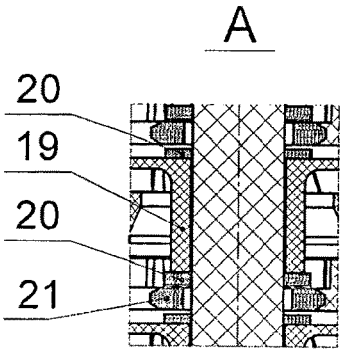
Figure 3:
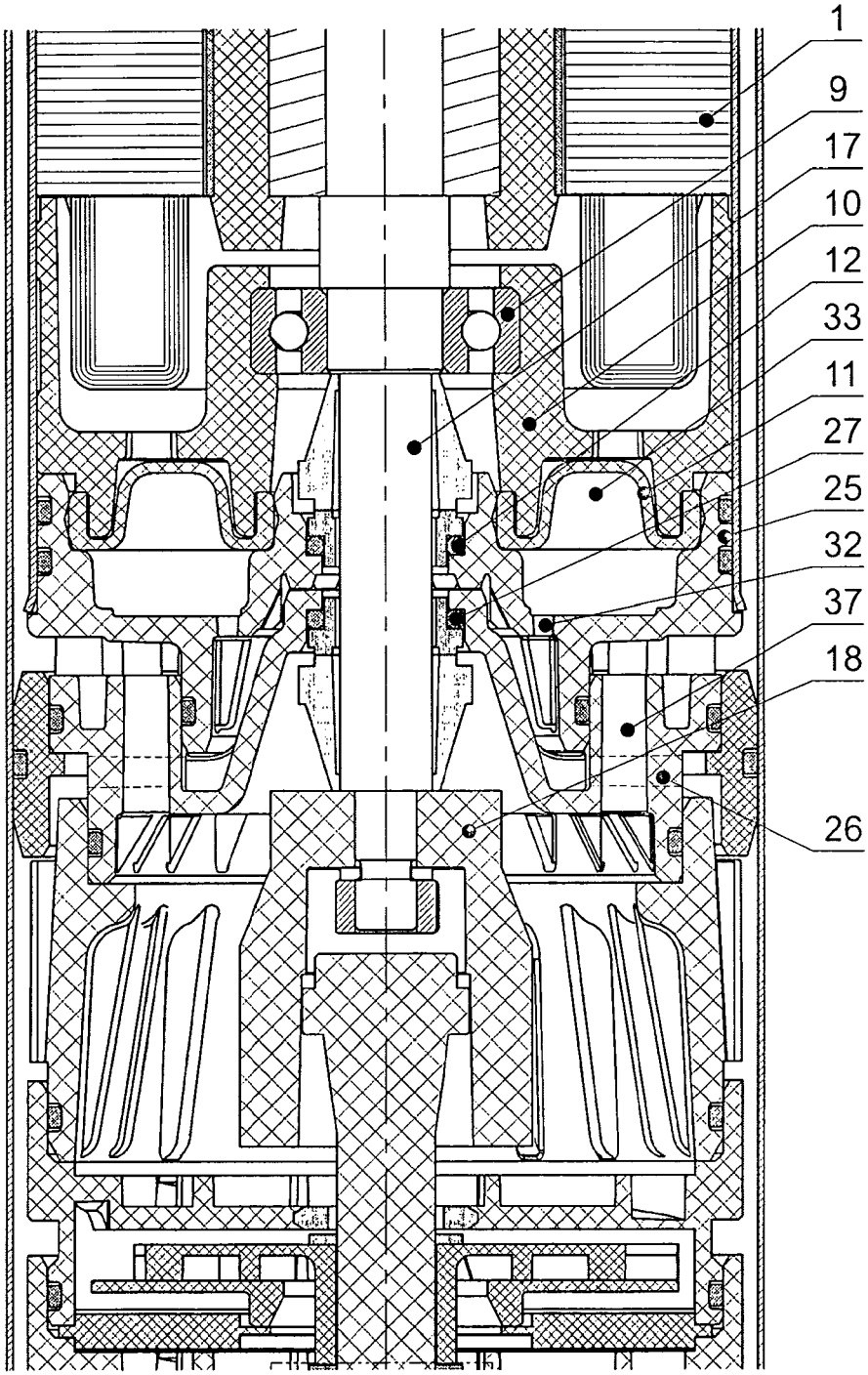
Figure 4:
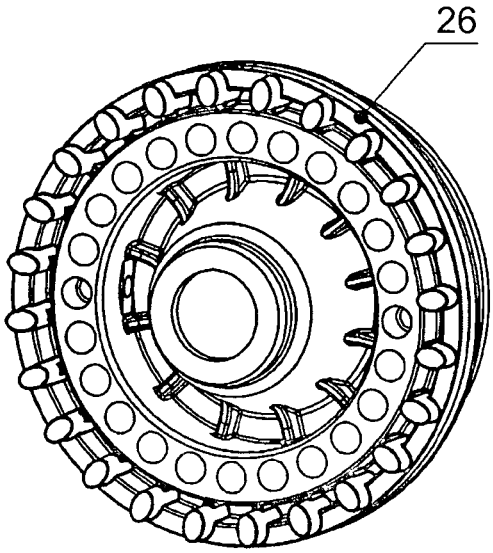
Figure 5:
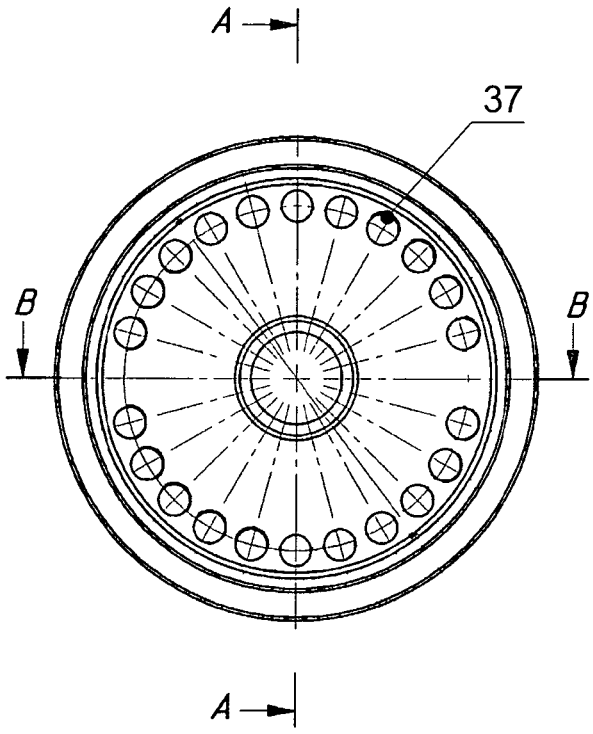
Figure 6:
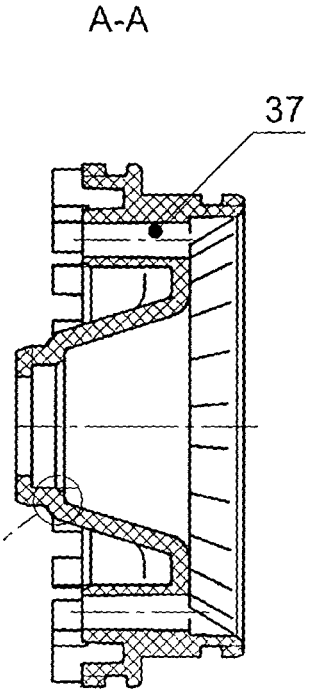
Figure 7:
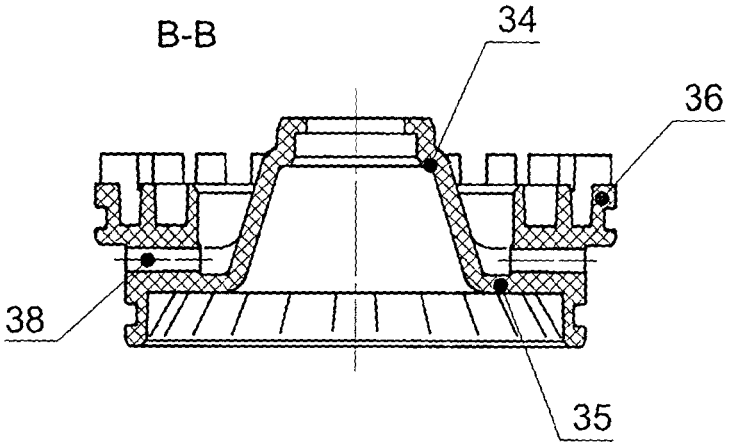

FIG. 1 shows a centrifugal multiple impeller electric pump Vodomet-Pro with a floating switch, longitudinal section, FIG. 2 shows detailed unit A from FIG. 1, FIG. 3 shows an enlarged fragment in electric motor seals zone, FIG. 4—multiple diameter intermediate case in three dimensional view, FIG. 5—multiple diameter intermediate case, front view, FIG. 6—A-A cross section of FIG. 5, FIG. 7—cross section of FIG. 5.

Centrifugal multiple impeller electric pump Vodomet contains installed in cases electric motor 1, in-built capacitor box 2 and impellers 3 (impeller package), located in a single casing 4 and center aligned by front and rear cover plates 5, 6 and intermediate support 7. Electric motor 1 is oil-filled, asynchronous, with square cage rotor 8, installed in rotated bearings 9. Front end shield 10 of electric motor 1 is sealed with an elastic membrane 11. Bearing 9 is poured into shield 10 when the latter is molded in injection molding machine. Thus, outer ring of bearing 9 is covered with plastic, providing its reliable fixation in end shield 10.

In-built capacitor box 2 is a sealed cavity accommodating capacitor 13 and terminals 14 for the connection of cable 15 with electric motor 1 windings. The capacitor box also accommodates thermal switch 30, installed on thermal contactor 29. Shaft 16 of impeller package 3 has an out-of-round section, e.g. hexagonal, and is connected with shaft 17 of electric motor 1 through coupling 18. Impeller package 3 includes impellers 19 and anti-friction washers 20. Impellers 19 are fitted on hexagonal shaft 16 with clearance permitting axial movement during assembly, for which purpose impeller crowns 19 have mounting openings corresponding to the out-of-round section of shaft 16.

Antifriction washers 20 interact with axial bearings of wear proof material made in form of ceramic inserts 21, which are installed in guidance rings 22. Impellers 3 also include the guidance rings 22, with covers 23 installed between them, having sealing annular elements contacting with impellers 19. The inserts 21 are supported by projections at flat ends of the impellers 19, forming seals separating suction and discharge cavities (not shown). The guidance rings 22 are sealed by radial seals forming a sealed package with the impellers 3. The impeller package 3, in its turn, is supported by a support 28 integrated with an intermediate multi-diameter case 26 with a pump section seal 27 installed in it. The case 26 and a front cover plate 25 of the electric motor 1 together form a channel system 32, 37, 38. Channels 32 are made in the front cover plate 25 along its axis. Channels 37, 38 do not intercross and are made in the case 26, with longitudinal channels positioned along its axis and the channels 38 radially. A rear cover plate 6 of the pump accommodates eyebolts (not shown) for cable securing, as well as sealed inputs of a floating switch cable 31 and the main cable 15. In a pump version without the floating switch 31, only sealed input for the main cable 15 is made. An antifriction bushing 24 supporting the shaft 16 of the impeller package 3 is installed in a front cover plate 5 of the electric pump. Gauzed suction apertures (not shown) are made in the front cover plate 5 of the electric pump, preventing large particles penetration in the pump, and channels (not shown) communicating a cavity 33 of the membrane 11 with an electric pump environment.

The front cover 25 of the electric motor 1 and the intermediate casing 26 are consistently placed between the end shield 10 of the electric motor 1 and the pressure connection, the front cover 25 of the electric motor 1 is formed with through holes 32 simply supported on one side by the diaphragm 11 to form an annular cavity 33, and is made compacted in relation to the shaft 17 of the motor 1 and the inner wall of the housing 4 and the intermediate casing 26 as well. The casing 26 is designed as a sleeve with a central conical projection 34 supported on the front cover 25 and sealed relative to the shaft 17. The projection 34 is connected with a peripheral annular sleeve 36 of the housing 26 by a jumper bar 35, which is sealed relative to the intermediate support 7 and the support 28 of the Impeller package 3. The casing 26 is made with non-intersecting holes 37, 38. The holes 37 are longitudinal (parallel to the axis of the body 26) and the holes 38 (shown in phantom in FIG. 3) are radial relative to the axis of the casing 26. The holes 37 are connected with the annular channel of the casing 4 and with a pressure side of the pack of impellers 3, and the radial holes 38 are connected with the suction side of the latter and with an annular cavity 33 formed between the diaphragm 11 of the end shield 10 and the front cover 25 of the motor 1. The essential feature of the pump "Vodomet-Pro" is the presence of the front cover 25 and the intermediate casing 26 with gaskets 12, 27 placed in a conical protrusion 34, and having different purposes. The gasket 27 of the pump section isolates the electric motor 1 from the effects of excess pressure generated by the impeller package 3, while the gasket 12 of the electric motor 1 seals the electric motor 1 directly and separates its internal volume filled with oil from one side and the medium merely in which electric pump is immersed.

DETAILED DESCRIPTION OF THE INVENTION

Preferred Embodiment

Electric pump works as follows. The pumped fluid enters the holes in the mesh cover 5. Then, due to the rotation of impellers 19 of the Impeller package 3, pumped fluid gets increments of kinetic energy, which is converted into pressure energy in the guidance rings 22. Under pressure through the interior of the support 28, the channel system 37 of the intermediate casing 26 and its clearance with the front cover 25 of the motor 1, the pumped fluid flows into the annular channel between the housing 4 and the body of the motor 1 and further—the capacitor housing box 2 cooling the motor 1 and through connected from an outside hose is sent to the consumer. Radial and axial forces arising during operation of the pump, in addition to the bearings 9 of the motor 1 effect on the antifriction washer 24. Generation of contact seals between projections 19 of the impellers 3 and sealing O-ring members of the covers 23 prevents leakage of the pumped fluid. The elastic membrane 11 allows balancing of pressure inside and outside of the electric motor 1 and to unload the gasket 12 of the electric motor 1 from the discharge pressure. The system of channels 32, 37, 38 allows to isolate the end shield 10 with the bearing 9, the gasket 12 of the electric motor 1 and the diaphragm 11 from the pressure developed by the pump, connecting their cavity 33 with the medium in which the motor pump is immersed. The motion of the pumped medium from the impellers injection in the annular channel 3 of the case 4 occurs through the holes 37 and communication of the cavity 33 membrane 11 with the medium (impeller intake 3)—through the holes 38, 32. Thermal contactor 29 prevents operation of the electric motor 1 when the oil temperature in it is more than 75° C. This eliminates the effect of high pressure on the elements of the electric motor 1 located in the casing 4 with a pumping portion (impellers 3), in particular on the gasket 12 and the diaphragm 11, which enhances the reliability and durability of the electric pump. Furthermore, since the guidance rings 22 has its radial seal, that eliminates leakage of the pumped fluid and ensures the absolute integrity of the impellers package 3. Location of the thermal switch 29 moved from the electric motor 1 oil-filled volume to the capacitor box 2 increases the reliability of its work, facilitates the diagnostics and repair of the electric pump in operation. All this is aimed at increasing the reliability and durability of the pump as a whole.

INDUSTRIAL APPLICATIONS

The present invention is embodied with multipurpose equipment extensively employed by the industry.

The invention claimed is:

1. A centrifugal multistage pump, comprising:

a. a case containing:
   i. an electric motor having a short-circuited rotor and an oil-filled body, and
   ii. a plurality of pump stages with a plurality of rotors,
   iii. the plurality of rotors installed and connected by a shaft, b. the electric motor is located at a pressure side of the plurality of pump stages and is installed in the case forming a circular channel for an environment that is being pumped over;

c. the electric motor is equipped with an additional support and a front bearing end shield that is sealed with an elastic diaphragm;

d. the electric motor has an electric motor shaft;

e. on the electric motor shaft there is a front cover and an intermediate stage case installed sequentially on two seals;

f. the front cover and the intermediate stage case have paths to connect an outer side of the elastic diaphragm to a suction side of the plurality of pump stages and paths to connect the circular channel of the case to the pressure side of the plurality of pump stages;

g. the front cover and the intermediate stage case are located sequentially between the front bearing end shield and a coupling;

h. the front cover has open-end holes and the front cover is supported by the elastic diaphragm forming an annular channel;

i. the front cover is thicker than the electric motor shaft with respect to a diameter from an axial line passing through a center of the electric motor shaft;

j. the case has an inner wall;

k. the intermediate stage case is supported by the front cover of the electric motor and is sealed by a first seal of the two seals in comparison with the electric motor shaft;

l. the front cover is connected with the intermediate stage case, sealed by a second seal of the two seals in comparison with an intermediate support and a support of the plurality of pump stages;

m. the intermediate stage case has axial and radial non-intersecting holes;

n. the axial holes are connected to the circular channel of the case and the pressure side of the plurality of pump stages, and the radial holes are connected to the suction side of the plurality of pump stages and the annular channel.

2. The centrifugal multistage pump according to claim 1, further comprising:

a. the plurality of pump stages are equipped with impeller guides and axial supports;

b. the plurality of rotors are sealed dividing pressure and suction zones;

c. antifrictional washers interact with the axial supports;

d. the shaft has a non-round profile and can move the impeller guides along a shaft axis;

e. the shaft is supported by an antifrictional bushing.

3. The centrifugal multistage pump according to claim 1, wherein a bearing of the electric motor shaft is sealed into the front bearing end shield while casting.

4. The centrifugal multistage pump according to claim 1, wherein: the centrifugal multistage pump is equipped with a condensing case where a thermoswitch, a capacitor, and cable connectors for the electric motor winding are located.

5. The centrifugal multistage pump according to claim 2, wherein the axial supports of the pump stages are made of a wearproof material.

6. The centrifugal multistage pump according to claim 1, wherein: the case has front and back end covers, and an antifrictional bushing is installed on the front cover of the case.

7. The centrifugal multistage pump according to claim 6, wherein: the centrifugal multistage pump is equipped with a fitting on the back end cover.

8. The centrifugal multistage pump according to claim 1, wherein: the two seals of the pump stages are thin-walled circular inlays.

* * * * *